US008703372B2

(12) United States Patent
Murakami et al.

(10) Patent No.: US 8,703,372 B2
(45) Date of Patent: Apr. 22, 2014

(54) ELECTROPHOTOGRAPHIC PHOTOSENSITIVE MEMBER, PROCESS CARTRIDGE, AND ELECTROPHOTOGRAPHIC APPARATUS

(71) Applicant: Canon Kabushiki Kaisha, Tokyo (JP)

(72) Inventors: Takeshi Murakami, Numazu (JP); Masataka Kawahara, Mishima (JP); Kaname Watariguchi, Mishima (JP); Masato Tanaka, Tagata-gun (JP); Akira Yoshida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/690,100

(22) Filed: Nov. 30, 2012

(65) Prior Publication Data

US 2013/0137026 A1 May 30, 2013

(30) Foreign Application Priority Data

Nov. 30, 2011 (JP) ..... 2011-262127
Nov. 6, 2012 (JP) ..... 2012-244530

(51) Int. Cl.
*G03G 5/047* (2006.01)

(52) U.S. Cl.
USPC ..... 430/59.4; 430/59.1; 430/76; 430/83; 399/159

(58) Field of Classification Search
USPC ..... 430/59.1, 59.4, 83, 76; 399/116, 159
See application file for complete search history.

(56) References Cited

U.S. PATENT DOCUMENTS

2011/0117483 A1* 5/2011 Ishiduka et al. ..... 430/56

FOREIGN PATENT DOCUMENTS

| | | | |
|---|---|---|---|
| GB | 1143482 | * | 2/1969 |
| JP | 61-77054 | A | 4/1986 |
| JP | 2-97956 | A | 4/1990 |
| JP | 2006-30699 | A | 2/2006 |

OTHER PUBLICATIONS

Diamond, A.S., ed., Handbook of Imaging Materials, Marcel Dekker, Inc., NY (1991), pp. 395-396.*
Caplus abstract AN. 1968:410295 describing GB 1,143,482, which entered STN on May 12, 1984, ACS on STN, copyright 2013.*
American Chemical Society (ACS) File Registry No. RN 19065-87-3, which entered STN on Nov. 16, 1984, ACS on STN, copyright 2013.*

* cited by examiner

*Primary Examiner* — Janis L Dote
(74) *Attorney, Agent, or Firm* — Canon U.S.A., Inc., IP Division

(57) ABSTRACT

An electrophotographic photosensitive member includes a support, a charge-generating layer disposed on the support, and a charge-transporting layer disposed on the charge-generating layer, in which the charge-generating layer contains a charge-generating substance and a compound represented by the formula (1). A process cartridge includes the electrophotographic photosensitive member described above. An electrophotographic apparatus includes the electrophotographic photosensitive member described above.

6 Claims, 3 Drawing Sheets

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

The present invention relates to an electrophotographic photosensitive member, a process cartridge including an electrophotographic photosensitive member, and an electrophotographic apparatus.

2. Description of the Related Art

As an electrophotographic photosensitive member to be installed in an electrophotographic apparatus, electrophotographic photosensitive members containing an organic photoconductive substance (charge-generating substance) have been used and widely studied.

In recent years, with increased use of charge-generating substances having higher sensitivity, there has been a problem in that decreases in sensitivity in charge-generating substances due to degradation by oxidation of charge-generating substances and changes in environment are observed. As a technique for improving a decrease in sensitivity of charge-generating substances, there are known techniques in which an anthraquinone derivative is incorporated into a charge-generating layer.

Japanese Patent Laid-Open No. 61-77054 (Patent Literature 1) discloses a technique in which an anthraquinone derivative is incorporated into a charge-generating layer in order to suppress degradation of a charge-generating substance due to ozone. Japanese Patent Laid-Open No. 2-97956 (Patent Literature 2) discloses a technique in which an anthraquinone derivative is incorporated into a charge-generating layer in view of an increase in the sensitivity of a charge-generating substance and stability in sensitivity and charging potential. Japanese Patent Laid-Open No. 10-63022 (Patent Literature 3) discloses a technique in which an anthraquinone derivative is incorporated into a charge-generating layer in order to adjust sensitivity. Furthermore, Japanese Patent Laid-Open No. 2006-30699 (Patent Literature 4) discloses a technique in which an anthraquinone derivative having an amino group or a hydroxy group is incorporated into a charge-generating layer in order to suppress the residual potential due to repeated use of a photosensitive member.

However, in addition to the problem described above, as a result of studies by the present inventors, it has been found that, by increasing the sensitivity of a charge-generating substance, the charge generation amount is increased, charges are likely to be retained in a charge-generating layer, and ghosting is likely to occur, which is a problem. Specifically, in an output image, a phenomenon called positive ghosting in which the density is increased only in portions irradiated with light during previous rotation or a phenomenon called negative ghosting in which the density is decreased only in portions irradiated with light during previous rotation is likely to occur. Even when any of the anthraquinone derivatives described in Patent Literatures 1 to 4 is used, suppression of ghosting is not sufficient in the case of repeated use of an electrophotographic photosensitive member.

SUMMARY OF THE INVENTION

Aspects of the present invention provide an electrophotographic photosensitive member which is excellent in suppressing ghosting in the case of repeated use of the electrophotographic photosensitive member, and a process cartridge and an electrophotographic apparatus each including the electrophotographic photosensitive member.

In an aspect, the present invention relates to an electrophotographic photosensitive member including a support, a charge-generating layer disposed on the support, and a charge-transporting layer disposed on the charge-generating layer, in which the charge-generating layer contains a charge-generating substance and a compound represented by the following formula (1):

(1)

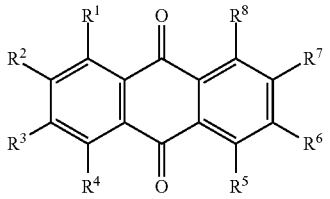

In the formula (1), $R^1$ to $R^8$ each independently represent a hydrogen atom, a halogen atom, a carboxyl group, an alkoxycarbonyl group, an aryloxycarbonyl group, an unsubstituted or substituted acyl group, an unsubstituted or substituted alkyl group, an unsubstituted or substituted alkoxy group, an unsubstituted or substituted aryloxy group, an unsubstituted or substituted amino group, or an unsubstituted or substituted cyclic amino group, and at least one of $R^1$ to $R^8$ is an unsubstituted or substituted cyclic amino group.

In another aspect, the present invention relates to a process cartridge detachably mountable to a main body of an electrophotographic apparatus, in which the process cartridge integrally supports the electrophotographic photosensitive member described above, and at least one device selected from the group consisting of a charging device, a developing device, a transferring device, and a cleaning device.

In another aspect, the present invention relates to an electrophotographic apparatus including the electrophotographic photosensitive member described above, a charging device, an exposure device, a developing device, and a transferring device.

According to aspects of the present invention, it is possible to provide an electrophotographic photosensitive member which is excellent in suppressing ghosting in the case of repeated use of the electrophotographic photosensitive member, and a process cartridge and an electrophotographic apparatus each including the electrophotographic photosensitive member.

Further features of the present invention will become apparent from the following description of exemplary embodiments with reference to the attached drawings.

DESCRIPTION OF THE EMBODIMENTS

Figure 1:
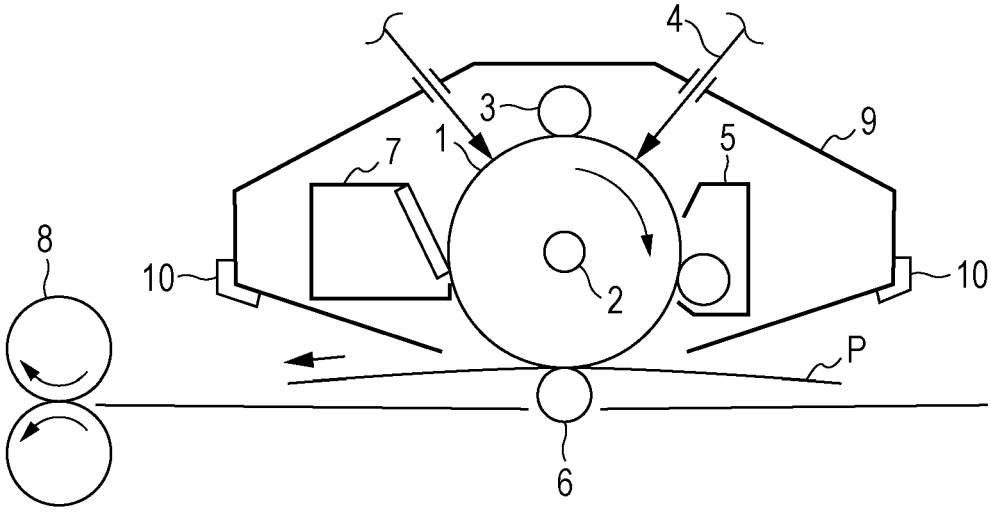
FIG. 1 is a view showing an example of a schematic structure of an electrophotographic apparatus provided with a process cartridge including an electrophotographic photosensitive member according to an embodiment of the present invention.

In an electrophotographic photosensitive member according to aspects of the present invention, a charge-generating layer contains a charge-generating substance and a compound represented by the following formula (1):

(1)

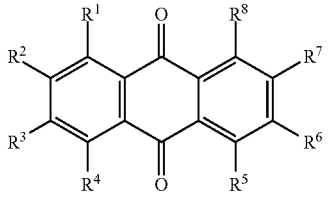

In the formula (1), $R^1$ to $R^8$ each independently represent a hydrogen atom, a halogen atom, a carboxyl group, an alkoxycarbonyl group, an aryloxycarbonyl group, an unsubstituted or substituted acyl group, an unsubstituted or substituted alkyl group, an unsubstituted or substituted alkoxy group, an unsubstituted or substituted aryloxy group, an unsubstituted or substituted amino group, or an unsubstituted or substituted cyclic amino group, and at least one of $R^1$ to $R^8$ is an unsubstituted or substituted cyclic amino group. The cyclic amino group refers to a heterocyclic structure containing a nitrogen atom.

Examples of the substituent of the substituted alkyl group, the substituent of the substituted alkoxy group, the substituent of the substituted aryloxy group, the substituent of the substituted amino group, and the substituent of the substituted cyclic amino group include a carboxyl group, a cyano group, a dialkylamino group, a hydroxy group, an alkyl group, an alkoxy-substituted alkyl group, a halogen-substituted alkyl group, an alkoxy group, an alkoxy-substituted alkoxy group, a halogen-substituted alkoxy group, a nitro group, and a halogen atom.

In the substituents described above, examples of the alkyl group include a methyl group, an ethyl group, and an n-propyl group. Examples of the alkylene group include a methylene group, an ethylene group, and an n-propylene group. Examples of the alkoxy-substituted alkyl group include a methoxymethyl group, and an ethoxymethyl group. Examples of the halogen-substituted alkyl group include a trifluoromethyl group and a trichloromethyl group. Examples of the alkoxy group include a methoxy group and an ethoxy group. Examples of the alkoxy-substituted alkoxy group include a methoxymethoxy group and an ethoxymethoxy group. Examples of the halogen-substituted alkoxy group include a trifluoromethoxy group and a trichloromethoxy group. Examples of the halogen atom include a fluorine atom, a chlorine atom, and a bromine atom. Examples of the dialkylamino group include a dimethylamino group and a diethylamino group.

From the standpoint of the ghost suppression effect, the unsubstituted or substituted cyclic amino group can be a morpholino group, a piperidino group, or a piperazino group.

The present inventors assume that the reason why the electrophotographic photosensitive member having the charge-generating layer containing the compound represented by the formula (1) exhibits an excellent effect of suppressing ghosting in the case of repeated use of the photosensitive member is as follows.

The compound represented by the formula (1) has a substituent introduced through the amino group, and the spatial extent of the electron orbitals of the anthraquinone structure, which is the basic skeleton, is deformed, which is believed to suppress retention of charges. However, when the spatial extent of the electron orbitals of the anthraquinone structure is deformed, the reduction potential is increased, resulting in a decrease in the electron-accepting capability. Accordingly, by using the cyclic amino group, it is possible to suppress an increase in the reduction potential and to deform the spatial extent of the electron orbitals of the anthraquinone structure while suppressing the decrease in the electron-accepting capability. Since the retention of charges is suppressed, it is believed that an excellent ghost suppression effect can be exhibited.

Specific examples of the compound represented by the formula (1) (exemplary compounds) are shown below.

(1-1)

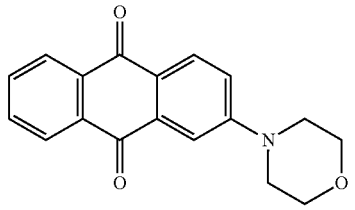

(1-2)

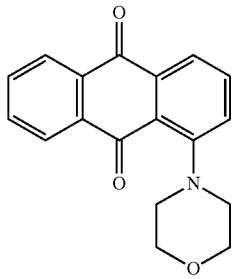

(1-3)

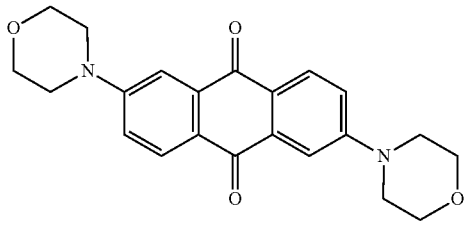

(1-4)

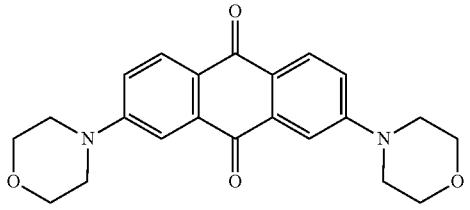

-continued
(1-5)
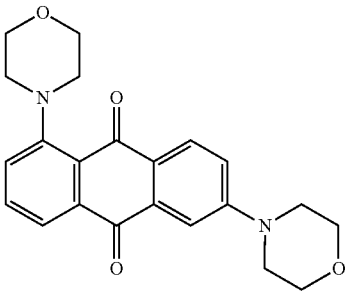
(1-6)
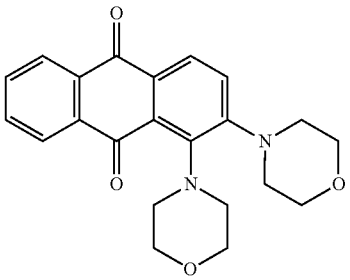
(1-7)
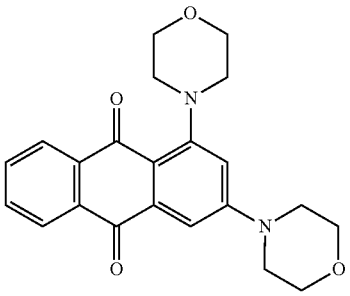
(1-8)
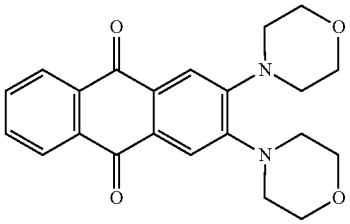
(1-9)
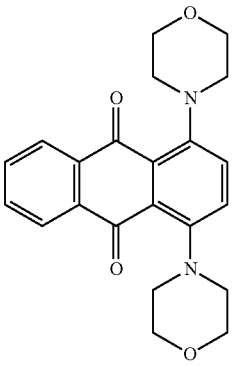
-continued
(1-10)
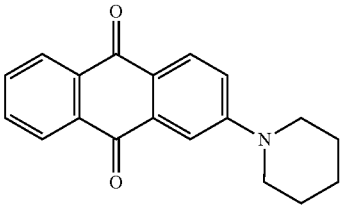
(1-11)
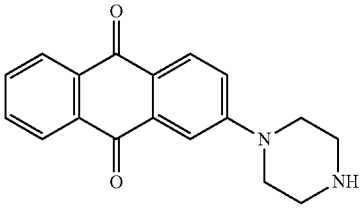
(1-12)
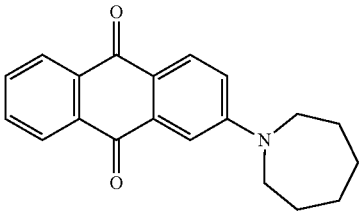
(1-13)
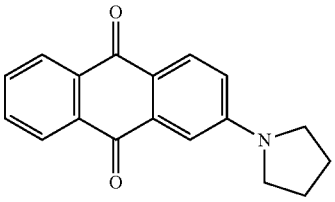
(1-14)
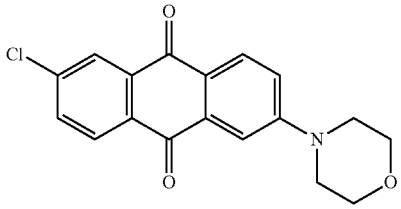
(1-15)
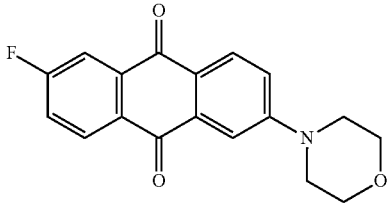
(1-16)
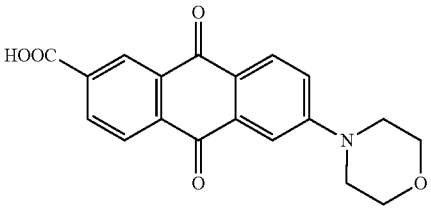

-continued (1-17)

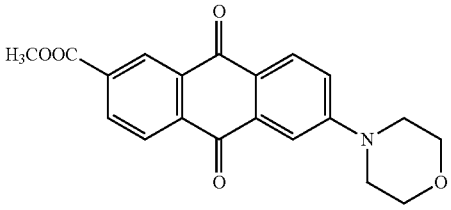

(1-18)

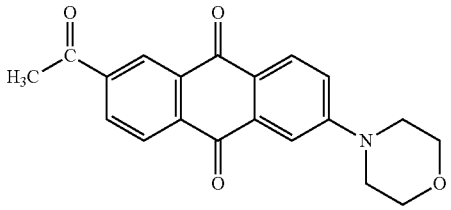

(1-19)

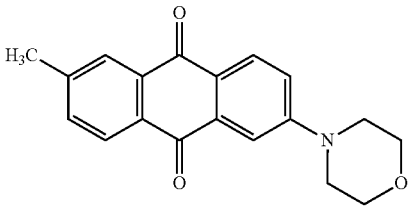

(1-20)

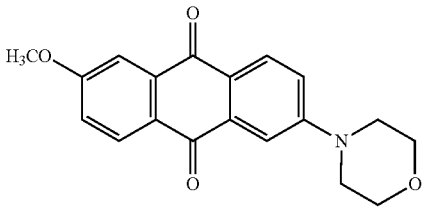

(1-21)

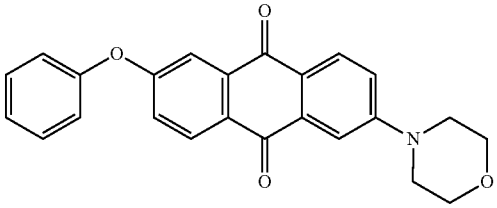

(1-22)

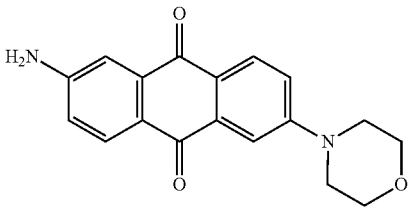

(1-23)

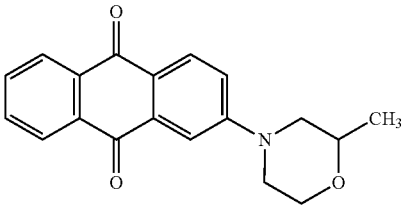

-continued (1-24)

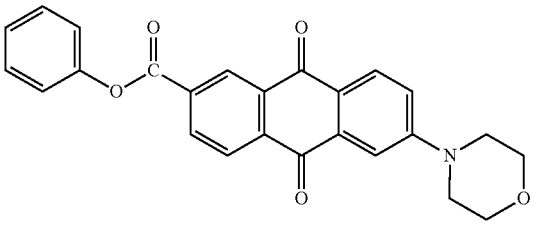

The compounds represented by the formula (1) may be used alone or in combination of two or more. Furthermore, the compounds represented by the formula (1) may be amorphous or crystalline.

The content of the compound represented by the formula (1) in the charge-generating layer may be 0.1% by mass to 20% by mass, such as 0.3% by mass to 10% by mass, relative to the charge-generating substance from the standpoint of the ghost suppression effect.

Furthermore, the content of the compound represented by the formula (1) in the charge-generating layer may be 0.05% by mass to 15% by mass, such as 0.1% by mass to 10% by mass, relative to the total mass of the charge-generating layer.

As the charge-generating substance to be incorporated into the charge-generating layer according to aspects of the present invention, a phthalocyanine pigment or an azo pigment can be used in view of high sensitivity. In particular, a phthalocyanine pigment can be used. Examples of the phthalocyanine pigment include metal-free phthalocyanines and metal phthalocyanines. These may have an axial ligand or a substituent. Among phthalocyanine pigments, in particular, oxy-titanium phthalocyanines and gallium phthalocyanines can be used because, while they have high sensitivity, they are likely to cause ghosting, on which aspects of the present invention effectively act.

Among gallium phthalocyanines, in particular, hydroxygallium phthalocyanines and chlorogallium phthalocyanines can be used.

Among hydroxygallium phthalocyanines, in particular, hydroxygallium phthalocyanine crystals with a crystal form having strong peaks at Bragg angles (2θ) of 7.4°±0.3° and 28.2°±0.3° in CuKα X-ray diffraction can be used. Among these, in particular, hydroxygallium phthalocyanine crystals with a crystal form having strong peaks at Bragg angles) (2θ±0.2° of 7.3°, 24.9°, and 28.1° and having the strongest peak at 28.1° and hydroxygallium phthalocyanine crystals with a crystal form having strong peaks at Bragg angles) (2θ±0.2° of 7.5°, 9.9°, 16.3°, 18.6°, 25.1°, and 28.3° can be used.

Among chlorogallium phthalocyanines, in particular, chlorogallium phthalocyanine crystals with a crystal form having strong peaks at Bragg angles (2θ±0.2° of 7.4°, 16.6°, 25.5°, and 28.3° can be used.

Among oxy-titanium phthalocyanines, in particular, oxy-titanium phthalocyanine crystals with a crystal form having a strong peak at a Bragg angle (2θ) of 27.2°±0.2° can be used.

Among them, in particular, hydroxygallium phthalocyanine crystals with a crystal form having strong peaks at Bragg angles (2θ) of 7.4°±0.3° and 28.2°±0.3° can be used.

Figure 2:
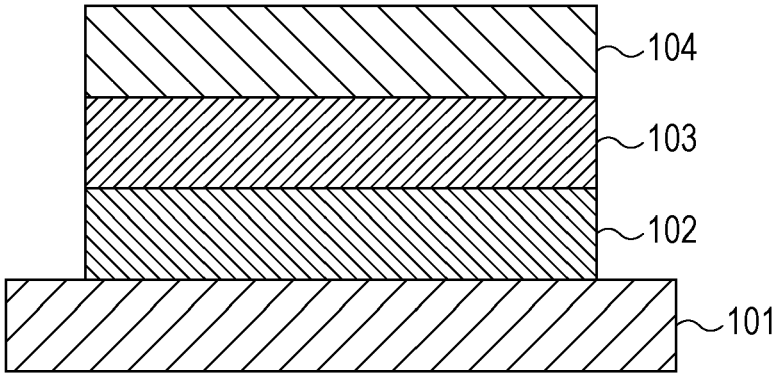
FIG. 2 is a view showing an example of a layer structure of an electrophotographic photosensitive member according to an embodiment of the present invention.

An electrophotographic photosensitive member according to aspects of the present invention includes a support, a charge-generating layer disposed on the support, and a charge-transporting layer disposed on the charge-generating layer. FIG. 2 is a view showing an example of the layer structure of an electrophotographic photosensitive member according to aspects of the present invention. In FIG. 2, reference sign 101 denotes a support, reference sign 102 denotes an undercoat layer, reference sign 103 denotes a charge-generating layer, and reference sign 104 denotes a charge-transporting layer.

The support can have conductivity (can be a conductive support). For example, the support may be made of a metal, such as aluminum, iron, copper, nickel, or zinc, or an alloy. In the case of a support made of aluminum or an aluminum alloy, an ED tube, an EI tube, or a support obtained by subjecting these to cutting, electrolytic grinding, or wet or dry honing may also be used. Furthermore, a metal support or a resin support having a thin film formed of a conductive material, such as aluminum, an aluminum alloy, or an indium oxide-tin oxide alloy, on the surface thereof can also be used. The surface of the support may be subjected to cutting treatment, roughening treatment, alumite treatment, or the like. A conductive layer can be formed by application of a conductive layer coating solution prepared by dispersing conductive particles, such as carbon black, metal particles, or metal oxide particles, together with a binder resin and a solvent, followed by drying and/or curing of the resulting coating film.

Examples of the resin that can be used in the conductive layer include acrylic resins, alkyd resins, epoxy resins, phenolic resins, butyral resins, polyacetal resins, polyurethane resins, polyester resins, polycarbonate resins, and melamine resins.

Examples of the solvent that can be used in the conductive layer coating solution include ether solvents, alcohol solvents, ketone solvents, and aromatic hydrocarbon solvents. The thickness of the conductive layer may be 0.2 to 40 μm, such as 5 to 40 μm.

An undercoat layer may be provided on the support (conductive layer). The undercoat layer can be formed by applying an undercoat layer coating solution containing a resin onto the support or the conductive layer, followed by drying or curing of the resulting coating film.

Examples of the resin that can be used in the undercoat layer include polyacrylic acids, methyl cellulose, ethyl cellulose, polyamide resins, polyimide resins, polyamide-imide resins, polyamic acid resins, melamine resins, epoxy resins, and polyurethane resins. Furthermore, metal oxide particles may be incorporated into the undercoat layer.

Examples of the solvent that can be used in the undercoat layer coating solution include ether solvents, alcohol solvents, ketone solvents, and aromatic hydrocarbon solvents. The thickness of the undercoat layer may be 0.05 to 40 μm, such as 0.3 to 5 μm. Furthermore, semiconductive particles, an electron-transporting substance, or an electron-accepting substance may be incorporated into the undercoat layer.

In the electrophotographic photosensitive member according to aspects of the present invention, a charge-generating layer is formed on the support, the conductive layer, or the undercoat layer. The charge-generating layer can be formed by application of a charge-generating layer coating solution prepared by dispersing the compound represented by the formula (1) and a charge-generating substance together with a binder resin and a solvent, followed by drying of the resulting coating film.

Examples of the binder resin that can be used in the charge-generating layer include polyester resins, acrylic resins, phenoxy resins, polycarbonate resins, polyvinyl butyral resins, polystyrene resins, polyvinyl acetate resins, polysulfone resins, polyarylate resins, polyvinylidene chloride resins, acrylonitrile copolymers, and polyvinyl benzal resins. Among these, in particular, polyvinyl butyral resins and polyvinyl benzal resins may be used.

The content of the charge-generating substance in the charge-generating layer may be 30% by mass to 90% by mass, such as 50% by mass to 80% by mass, relative to the total mass of the charge-generating layer.

Examples of the solvent that can be used in the charge-generating layer coating solution include alcohol solvents, sulfoxide solvents, ketone solvents, ether solvents, ester solvents, and aromatic hydrocarbon solvents. The thickness of the charge-generating layer may be 0.05 to 1 μm, such as 0.1 to 0.3 μm.

A charge-transporting layer is provided on the charge-generating layer. The charge-transporting layer can be formed by application of a charge-transporting layer coating solution prepared by dissolving a charge-transporting substance and a binder resin in a solvent, followed by drying of the resulting coating film.

The content of the charge-transporting substance may be 20% by mass to 80% by mass, such as 30% by mass to 60% by mass, relative to the total mass of the charge-transporting layer.

Examples of the charge-transporting substance that can be used in the charge-transporting layer include triarylamine compounds, hydrazone compounds, stilbene compounds, pyrazoline compounds, oxazole compounds, thiazole compounds, and triarylmethane compounds. Among these, in particular, triarylamine compounds may be used.

Examples of the binder resin that can be used in the charge-transporting layer include polyester resins, acrylic resins, phenoxy resins, polycarbonate resins, polystyrene resins, polyvinyl acetate resins, polysulfone resins, polyarylate resins, polyvinylidene chloride resins, and acrylonitrile copolymers. Among these, in particular, polycarbonate resins and polyarylate resins may be used.

Examples of the solvent that can be used in the charge-transporting layer coating solution include ether solvents, alcohol solvents, ketone solvents, and aromatic hydrocarbon solvents. The thickness of the charge-transporting layer may be 5 to 40 μm, such as 10 to 25 μm.

A protective layer may be provided on the charge-transporting layer for the purpose of protecting the photosensitive layers (charge-generating layer and charge-transporting layer).

The protective layer can be formed by application of a protective layer coating solution obtained by dissolving a binder resin in a solvent, followed by drying of the resulting coating film. Examples of the binder resin that can be used in the protective layer include polyvinyl butyral resins, polyester resins, polycarbonate resins, polyamide resins, polyimide resins, polyarylate resins, polyurethane resins, styrene-butadiene copolymers, styrene-acrylic acid copolymers, and styrene-acrylonitrile copolymers.

Furthermore, in order to enable the protective layer to have charge transport ability, the protective layer may be formed by curing a monomer material having charge transport ability or a polymer-type charge-transporting substance using any of various crosslinking reactions. In particular, a layer can be formed by curing by polymerization or crosslinking of a charge-transporting compound having a chain polymerizable functional group. Examples of the chain polymerizable functional group include an acryl group, a methacryl group, an alkoxysilyl group, and an epoxy group. Examples of the curing reaction include radical polymerization, ionic polymerization, thermal polymerization, photopolymerization, and radiation polymerization (electron radiation polymerization).

Examples of the solvent that can be used in the protective layer coating solution include ether solvents, alcohol solvents, ketone solvents, and aromatic hydrocarbon solvents. The thickness of the protective layer may be 0.05 to 20 μm, such as 1 to 7 μm. Furthermore, optionally, conductive particles or the like may be added to the protective layer.

Furthermore, it may to possible to incorporate conductive particles, an ultraviolet absorber, or lubricating particles such as fluorine atom-containing resin particles into the outermost surface layer (charge-transporting layer or protective layer) of the electrophotographic photosensitive member. Examples of the conductive particles include metal oxide particles, such as tin oxide particles.

When the individual layer coating solutions are applied, for example, a dip coating method (dipping method), a spray coating method, a spinner coating method, a bead coating method, a blade coating method, a beam coating method, or the like may be used.

FIG. 1 shows a schematic structure of an electrophotographic apparatus provided with a process cartridge including an electrophotographic photosensitive member according to an embodiment of the present invention.

In FIG. 1, reference sign 1 denotes a cylindrical (drum-like) electrophotographic photosensitive member, which is rotated around a shaft 2 at a predetermined peripheral speed (processing speed) in the direction indicated by an arrow. The surface of the electrophotographic photosensitive member 1 which is rotated is uniformly charged to a predetermined positive or negative potential by charging device 3 during rotation. Subsequently, the surface of the electrophotographic photosensitive member 1 receives exposure light (image exposure light) 4 outputted from an exposure device (not shown), such as slit exposure or laser beam scanning exposure, and intensity-modified according to a time-series electrical digital image signal of target image information. Thus, an electrostatic latent image corresponding to the target image is sequentially formed on the surface of the electrophotographic photosensitive member 1.

The electrostatic latent image formed on the surface of the electrophotographic photosensitive member 1 is developed by a toner which is contained in a developer of the developing device 5, by reversal development, to be a toner image. Subsequently, the toner image formed and carried on the surface of the electrophotographic photosensitive member 1 is sequentially transferred onto a transfer medium (paper or the like) P by a transferring bias from transferring device (transfer roller or the like) 6. In this process, the transfer medium P is fed from a transfer medium feeding device (not shown) into a portion (contact portion) between the electrophotographic photosensitive member 1 and the transferring device 6 in synchronization with the rotation of the electrophotographic photosensitive member 1. Furthermore, a bias voltage having a reverse polarity to the charge polarity of the toner is applied to the transferring device 6 from a bias supply (not shown).

The transfer medium P to which the toner image has been transferred is separated from the surface of the electrophotographic photosensitive member 1 and conveyed to a fixing device 8 where the toner image is subjected to a fixing process. Then, the transfer medium P is conveyed as an image-formed product (print or copy) to the outside of the apparatus.

The remaining developer untransferred (remaining toner untransferred) on the surface of the electrophotographic photosensitive member 1, from which the toner image has been transferred, is removed by a cleaning device (cleaning blade or the like) 7 so that the surface is cleaned. Subsequently, de-charging treatment is performed by pre-exposure light (not shown) from a pre-exposing device (not shown), and then the electrophotographic photosensitive member 1 is repeatedly used for image formation. In addition, in the case where the charging device 3 is a contact charging device using a charging roller or the like as shown in FIG. 1, pre-exposure is not necessarily required.

According to aspects of the present invention, a plurality of components selected from the electrophotographic photosensitive member 1, the charging device 3, the developing device 5, the transferring device 6, and the cleaning device 7 may be held in a container and integrally held together to constitute a process cartridge. Furthermore, the process cartridge may be configured so as to be detachably mountable to the main body of an electrophotographic apparatus, such as a copying machine or a laser beam printer. Referring to FIG. 1, the electrophotographic photosensitive member 1, the charging device 3, the developing device 5, and the cleaning device 7 are integrally held to constitute a cartridge, and the cartridge is used as a process cartridge 9 which is detachably mountable to the main body of an electrophotographic apparatus, using a guiding device 10, such as a rail of the main body of the electrophotographic apparatus.

In the case where the electrophotographic apparatus is a copying machine or a printer, the exposure light 4 is reflected light or transmitted light from an original. Alternatively, the exposure light 4 is light irradiated by scanning with a laser beam according to signals into which an original read by a sensor is converted, or driving of an LED array or a liquid-crystal shutter array.

EXAMPLES

Aspects of the present invention will be described in more detail below on the basis of specific examples. However, it is to be understood that the present invention is not limited thereto. In the examples, the term "part(s)" refers to "part(s) by mass". Furthermore, in Examples and Comparative Example, the thickness was obtained with an eddy-current type film thickness meter (Fischerscope, manufactured by Fischer Instruments, Inc.) or by specific gravity conversion on the basis of the mass per unit area.

Example 1

An aluminum cylinder (JIS-A3003, aluminum alloy) with a diameter of 30 mm and a length of 260.5 mm was used as a support (conductive support).

Next, 60 parts of tin oxide-coated barium sulfate particles (trade name: PASSTRAN PC1, manufactured by Mitsui Mining & Smelting Co., Ltd.), 15 parts of titanium oxide particles (trade name: TITANIX JR, manufactured by Tayca Corp.), 43 parts of a resol-type phenolic resin (trade name: PHENOLITE J-325, manufactured by DIC Corp., solid content 70% by mass), 0.015 parts of a silicone oil (trade name: SH28PA, manufactured by Dow Corning Toray Co., Ltd.), and 3.6 parts of a silicone resin (trade name: TOSPEARL 120, manufactured by Toshiba Silicone Co., Ltd.) were mixed with a mixed solvent containing 50 parts of 2-methoxy-1-propanol and 50 parts of methanol, and dispersion treatment was performed for about 20 hours with a ball mill to prepare a conductive layer coating solution.

This conductive layer coating solution was applied onto the conductive support by dip coating, and the resulting coating film was thermally cured at 140° C. for one hour. Thereby, a conductive layer with a thickness of 15 μm was formed.

Next, by dissolving 10 parts of a copolymer nylon resin (trade name: CM8000, manufactured by Toray Industries, Inc.) and 30 parts of an N-methoxymethylated nylon 6 resin (trade name: TORESIN EF-30T, manufactured by Nagase Chemtex) in a mixed solvent containing 400 parts of methanol and 200 parts of n-butanol, an undercoat layer coating solution was prepared.

This undercoat layer coating solution was applied onto the conductive layer by dip coating, and the resulting coating film was dried by heating at 100° C. for 30 minutes. Thereby, an undercoat layer with a thickness of 0.45 μm was formed.

Next, 10 parts of hydroxygallium phthalocyanine crystals (charge-generating substance) with a crystal form having strong peaks at Bragg angles (2θ±0.2° of 7.5°, 9.9°, 16.3°, 18.6°, 25.1°, and 28.3° in CuKα X-ray diffraction was prepared, and 0.01 parts (0.1 parts by mass relative to the charge-generating substance) of the exemplary compound (1-1), 5 parts of a polyvinyl butyral resin (trade name: S-LEC BX-1, manufactured by Sekisui Chemical co., Ltd., and 250 parts of cyclohexanone were mixed therewith. The mixture was dispersed in a sand mill using glass beads with a diameter of 1 mm for 4 hours. Then, 250 parts of ethyl acetate was added thereto, and a dispersion for a charge-generating layer was prepared.

This charge-generating layer coating solution was applied onto the undercoat layer by dip coating, and the resulting coating film was dried at 80° C. for 15 minutes. Thereby, a charge-generating layer with a thickness of 0.17 μm was formed. The content of the exemplary compound was 0.067% by mass relative to the total mass of the charge-generating layer.

Next, by dissolving 70 parts of the compound (charge-transporting substance) represented by the formula (2) below and 100 parts of a polycarbonate resin (trade name: IUPILON Z200, manufactured by Mitsubishi Engineering-Plastics Corp.) in a mixed solvent containing 600 parts of monochlorobenzene and 200 parts of dimethoxymethane, a charge-transporting layer coating solution was prepared.

(2)

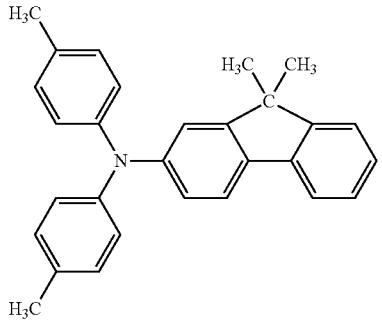

This charge-transporting layer coating solution was applied onto the charge-generating layer by dip coating, and the resulting coating film was dried at 100° C. for 30 minutes. Thereby, a charge-transporting layer with a thickness of 15 μm was formed.

In such a manner, an electrophotographic photosensitive member including the conductive support, the conductive layer, the undercoat layer, the charge-generating layer, and the charge-transporting layer was produced.

Examples 2 to 27

Electrophotographic photosensitive members were produced as in Example 1 except that the type and content of the compound represented by the formula (1) in Example 1 were changed to those shown in Table 1.

Example 28

An electrophotographic photosensitive member was produced as in Example 4 except that the charge-generating layer coating solution was prepared by changing the hydroxygallium phthalocyanine, as the charge-generating substance, in Example 3, to 10 parts of oxy-titanium phthalocyanine crystals with a crystal form having strong peaks at Bragg angles (2θ±0.2° of 9.0°, 14.2°, 23.9°, and 27.1° in CuKα X-ray diffraction.

TABLE 1

| | Exemplary compound | | |
|---|---|---|---|
| | Type | Content relative to charge-generating substance (% by mass) | Content relative to total mass of charge-generating layer (% by mass) |
| Example 1 | (1-1) | 0.1 | 0.067 |
| Example 2 | (1-1) | 1 | 0.66 |
| Example 3 | (1-1) | 5 | 3.2 |
| Example 4 | (1-1) | 10 | 6.3 |
| Example 5 | (1-2) | 5 | 3.2 |
| Example 6 | (1-3) | 5 | 3.2 |
| Example 7 | (1-4) | 5 | 3.2 |
| Example 8 | (1-5) | 5 | 3.2 |
| Example 9 | (1-6) | 5 | 3.2 |
| Example 10 | (1-7) | 5 | 3.2 |
| Example 11 | (1-8) | 5 | 3.2 |
| Example 12 | (1-9) | 5 | 3.2 |
| Example 13 | (1-10) | 5 | 3.2 |
| Example 14 | (1-11) | 5 | 3.2 |
| Example 15 | (1-12) | 5 | 3.2 |
| Example 16 | (1-13) | 5 | 3.2 |
| Example 17 | (1-14) | 5 | 3.2 |
| Example 18 | (1-15) | 5 | 3.2 |
| Example 19 | (1-16) | 5 | 3.2 |
| Example 20 | (1-17) | 5 | 3.2 |
| Example 21 | (1-18) | 5 | 3.2 |
| Example 22 | (1-19) | 5 | 3.2 |
| Example 23 | (1-20) | 5 | 3.2 |
| Example 24 | (1-21) | 5 | 3.2 |
| Example 25 | (1-22) | 5 | 3.2 |
| Example 26 | (1-23) | 5 | 3.2 |
| Example 27 | (1-24) | 5 | 3.2 |
| Example 28 | (1-1) | 5 | 3.2 |

Comparative Example 1

An electrophotographic photosensitive member was produced as in Example 1 except that the charge-generation layer coating solution was prepared without using the exemplary compound (1-1) in Example 1.

Comparative Example 2

An electrophotographic photosensitive member was produced as in Example 28 except that the charge-generating layer coating solution was prepared without using the exemplary compound (1-1) in Example 28.

Comparative Example 3

An electrophotographic photosensitive member was produced as in Example 4 except that the exemplary compound (1-1) was changed to the compound represented by the formula (C-1) below in Example 3.

Comparative Example 4

An electrophotographic photosensitive member was produced as in Example 4 except that the exemplary compound (1-1) was changed to the compound represented by the formula (C-2) below in Example 3.

Comparative Example 5

An electrophotographic photosensitive member was produced as in Example 4 except that the exemplary compound (1-1) was changed to the compound represented by the formula (C-3) below in Example 3.

Comparative Example 6

An electrophotographic photosensitive member was produced as in Example 4 except that the exemplary compound (1-1) was changed to the compound represented by the formula (C-4) below in Example 3.

Comparative Example 7

An electrophotographic photosensitive member was produced as in Example 4 except that the exemplary compound (1-1) was changed to the compound represented by the formula (C-5) below in Example 3.

Comparative Example 8

An electrophotographic photosensitive member was produced as in Example 4 except that the exemplary compound (1-1) was changed to the compound represented by the formula (C-6) below in Example 3.

Comparative Example 9

An electrophotographic photosensitive member was produced as in Example 4 except that the exemplary compound (1-1) was changed to 0.5 parts of 1,2-dihydroxyanthraquinone (manufactured by Tokyo Chemical Industry Co., Ltd.) in Example 3.

(C-1)

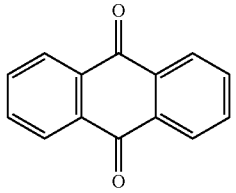

(C-2)

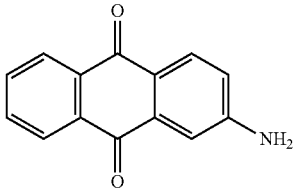

-continued (C-3)

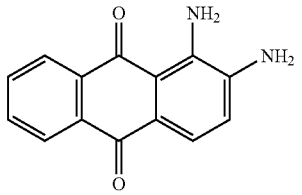

(C-4)

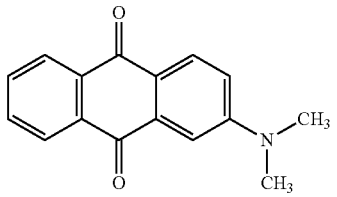

(C-5)

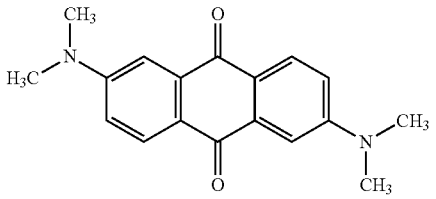

(C-6)

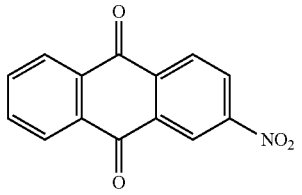

The electrophotographic photosensitive members of Examples 1 to 28 and Comparative Examples 1 to 9 were evaluated by the method described below.

As an electrophotographic apparatus for evaluation, a laser beam printer, Color Laser Jet CP3525dn, manufactured by Hewlett-Packard Company was used by modifying it such that the pre-exposure light was not turned on and the charging conditions and the laser exposure amount could be varied. Furthermore, the produced electrophotographic photosensitive member was installed in a cyan process cartridge, and the cyan process cartridge was mounted on a cyan process cartridge station.

The drum surface potentials were set such that the initial dark-area potential was −500 V and the light-area potential was −150 V in an environment of a temperature of 12° C. and a humidity of 10% RH. In order to measure the surface potentials in the setting of the potentials, the cartridge was modified. A potential probe (trade name: MODEL 6000B-8, manufactured by TREK Japan KK) was installed at the development position, and the potentials at the center of the drum were measured using a surface potential meter (trade name: MODEL 344, manufactured by TREK Japan KK).

Then, an image was outputted on 5,000 sheets with single cyan color. In this case, a character image having a coverage rate of 1% was outputted using A4-size plain paper. Ghost image evaluation was performed in the initial stage of the image output and after the image output on 5,000 sheets.

Figure 3:
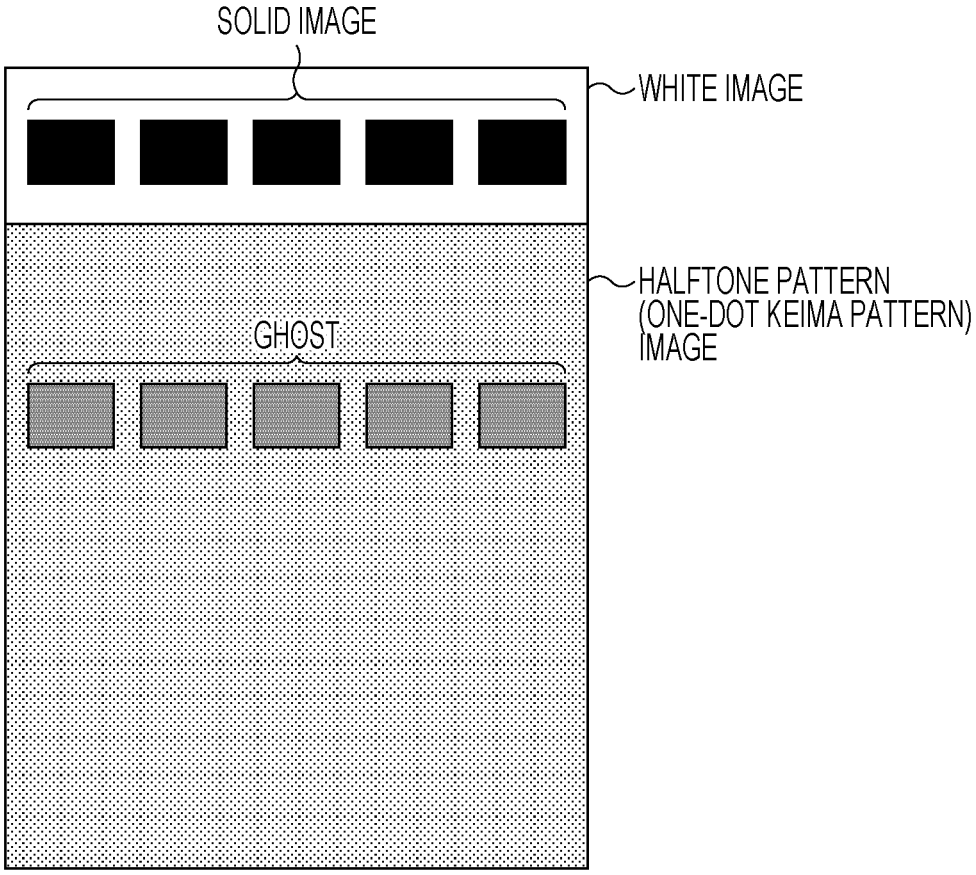
FIG. 3 is a view illustrating a print for ghost evaluation which is used when evaluating ghost images.

The ghost image evaluation was performed using an image for ghost evaluation, which was prepared by outputting square solid images in a white background (white image) on the top part of the image, and then forming a halftone pattern (one-dot keima pattern) image, as shown in FIG. 3. In FIG. 3, a portion denoted as "ghost" is a ghost portion in which presence or absence of ghosting due to the solid image is evaluated. When ghosting appears, it appears in the "ghost" areas shown in FIG. 3. Ghost evaluation was performed in the following order: a white image was outputted on one sheet, then, the image for ghost evaluation was continuously outputted on five sheets, a black solid image was outputted on one sheet, and the image for ghost evaluation was outputted again on five sheets. Evaluation was performed using ten sheets in total on which the image for ghost evaluation was outputted. In the evaluation, a difference in density between the image density of the halftone pattern (one-dot keima pattern) image and the image density of the ghost portion was measured at 10 points for each sheet of the image for ghost evaluation, using a spectrodensitometer (trade name: X-RITE 504/508, manufactured by X-Rite Corp). The average value of 10 points was considered as the result of the sheet. Measurement was performed in the same manner on the ten sheets of the image for ghost evaluation, and the average value thereof was calculated. The results are shown in Table 2. Regarding the difference in density, a smaller value indicates better suppression of ghosting. In the case where the difference in density is 0.05 or more, suppression of ghosting is insufficient, and it is evaluated that the effect according to aspects of the present invention is not obtained.

TABLE 2

| | Ghost image evaluation | |
|---|---|---|
| | Initial stage | After 5000 sheets |
| Example 1 | 0.028 | 0.033 |
| Example 2 | 0.024 | 0.028 |
| Example 3 | 0.021 | 0.024 |
| Example 4 | 0.023 | 0.027 |
| Example 5 | 0.024 | 0.028 |
| Example 6 | 0.030 | 0.034 |
| Example 7 | 0.031 | 0.034 |
| Example 8 | 0.032 | 0.036 |
| Example 9 | 0.024 | 0.028 |
| Example 10 | 0.026 | 0.029 |
| Example 11 | 0.025 | 0.030 |
| Example 12 | 0.028 | 0.033 |
| Example 13 | 0.022 | 0.027 |
| Example 14 | 0.022 | 0.028 |
| Example 15 | 0.025 | 0.032 |
| Example 16 | 0.024 | 0.031 |
| Example 17 | 0.022 | 0.026 |
| Example 18 | 0.022 | 0.026 |
| Example 19 | 0.024 | 0.029 |
| Example 20 | 0.025 | 0.030 |
| Example 21 | 0.025 | 0.032 |
| Example 22 | 0.022 | 0.028 |
| Example 23 | 0.023 | 0.029 |
| Example 24 | 0.025 | 0.031 |
| Example 25 | 0.023 | 0.028 |
| Example 26 | 0.026 | 0.031 |
| Example 27 | 0.024 | 0.033 |
| Example 28 | 0.028 | 0.033 |
| Comparative Example 1 | 0.045 | 0.100 |
| Comparative Example 2 | 0.049 | 0.102 |
| Comparative Example 3 | 0.040 | 0.088 |
| Comparative Example 4 | 0.037 | 0.080 |
| Comparative Example 5 | 0.034 | 0.076 |
| Comparative Example 6 | 0.033 | 0.071 |
| Comparative Example 7 | 0.033 | 0.074 |
| Comparative Example 8 | 0.045 | 0.100 |
| Comparative Example 9 | 0.035 | 0.072 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-262127 filed Nov. 30, 2011 and No. 2012-244530 filed Nov. 6, 2012, which are hereby incorporated by reference herein in their entirety.

What is claimed is:

1. An electrophotographic photosensitive member comprising:

a conductive support;

a charge-generating layer disposed on the support; and a charge-transporting layer disposed on the charge-generating layer, wherein the charge-generating layer comprises:

a charge-generating substance, and a compound represented by the following formula (1); and (1)

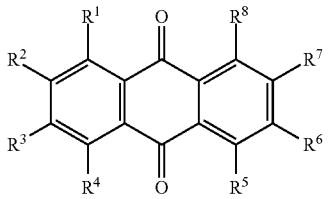

wherein, $R^1$ to $R^8$ each independently represent a hydrogen atom, a halogen atom, a carboxyl group, an alkoxycarbonyl group, an aryloxycarbonyl group, an unsubstituted or substituted acyl group, an unsubstituted or substituted alkyl group, an unsubstituted or substituted alkoxy group, an unsubstituted or substituted aryloxy group, an unsubstituted or substituted amino group, a morpholinyl group, a piperidino group, or a piperazino group, and at least one of $R^1$ to $R^8$ is a morpholinyl group, a piperidino group, or a piperazino group.

2. The electrophotographic photosensitive member according to claim 1, wherein the charge-generating substance is a phthalocyanine pigment.

3. The electrophotographic photosensitive member according to claim 1, wherein the content of the compound represented by the formula (1) in the charge-generating layer is 0.1% by mass to 10% by mass relative to the charge-generating substance in the charge-generating layer.

4. The electrophotographic photosensitive member according to claim 1, wherein the content of the compound represented by the formula (1) in the charge-generating layer is 0.05% by mass to 15% by mass relative to the total mass of the charge-generating layer.

5. A process cartridge detachably mountable to a main body of an electrophotographic apparatus, wherein the process cartridge integrally supports:

the electrophotographic photosensitive member according to claim 1, and at least one device selected from the group consisting of a charging device, a developing device, a transferring device, and a cleaning device.

6. An electrophotographic apparatus comprising:

the electrophotographic photosensitive member according to claim 1;

a charging device;
an exposure device;
a developing device; and
a transferring ⁵ device.

* * * * *